US005096429A

United States Patent [19]

Fraser

[11] Patent Number: 5,096,429

[45] Date of Patent: Mar. 17, 1992

[54] SYSTEM FOR BUILDING UP EXPOSED DOUBLE-VOLTAGE ELECTRIFIED LINES FOR SUPPORTING USER APPLIANCES, PARTICULARLY LIGHTING LAMPS FOR INTERNAL ENVIRONMENTS

[75] Inventor: Alberto Fraser, Milan, Italy

[73] Assignee: DIL S.r.l., Italy

[21] Appl. No.: 558,781

[22] Filed: Jul. 26, 1990

[30] Foreign Application Priority Data

Apr. 2, 1990 [IT] Italy ..... 2918 A/90

[51] Int. Cl.[5] ..... H01R 25/14

[52] U.S. Cl. ..... 439/115; 439/210

[58] Field of Search ..... 439/110-122, 439/207-216

[56] References Cited

U.S. PATENT DOCUMENTS 3,871,730 3/1975 Hesse ..... 439/115
4,053,194 10/1977 Gilman ..... 439/115
4,105,099 8/1978 Bertrams et al. ..... 439/213
4,256,357 3/1981 Vasseur et al. ..... 439/115

FOREIGN PATENT DOCUMENTS 2123152 11/1972 Fed. Rep. of Germany ..... 439/207

*Primary Examiner*—Gary F. Paumen
*Attorney, Agent, or Firm*—Steinberg & Raskin

[57] ABSTRACT

This system for building up electrified lines in the form of double-voltage exposed modules for supporting user appliances, particularly lighting lamps for interior environments, is formed from track pieces of standardized length along which conductors extend to form electrical lines, said track pieces being connectable together with the aid of interposable means including a prismatic box of square cross-section which is open at one of its ends to form various geometrical configuration suggested by aesthetic and/or functional requirements, and being combinable with supports for user appliances, particularly lamps of various types, along their entire length.

37 Claims, 12 Drawing Sheets

SYSTEM FOR BUILDING UP EXPOSED DOUBLE-VOLTAGE ELECTRIFIED LINES FOR SUPPORTING USER APPLIANCES, PARTICULARLY LIGHTING LAMPS FOR INTERNAL ENVIRONMENTS

FIELD OF THE INVENTION

This invention relates to a system for building up exposed electrified lines for supporting user appliances, particularly lighting means.

BACKGROUND AND SUMMARY OF THE INVENTION

The system comprises a plurality of fittings or means, consisting essentially of:

a box for initially connecting a first track piece to the means;

electrically conducting track pieces of standardized length;

elements for electrically and mechanically connecting together the various electrically conducting track pieces to form them into an unlimited straight length;

elements for electrically and mechanically connecting together the various track pieces to form them into perpendicular geometrical configurations such as a cross, an L or a T;

flexible elements for electrically connecting together the various track pieces to form them into any angular arrangement;

pairs of opposing elements to be mounted at the two ends of a track piece for supporting fluorescent tubes and their feed components;

boxes to be fixed mechanically to the body of the track pieces to enable electric current to be withdrawn from the lines present within them;

boxes as above provided with a line selector:

means for fixing or supporting or suspending the track pieces. Certain types of such component fittings or devices already exist but suffer from unsatisfactory functional, aesthetic, cost or production aspects, which it is the object of the sectional system of the present invention to improve by a series of expedients and technical concepts which are all listed and specified in the accompanying claims.

BRIEF DESCRIPTION OF THE DRAWINGS

The system is shown in its constituent parts by way of non-limiting example on the accompanying drawings, in which.

DETAILED DESCRIPTION

Figure 1:
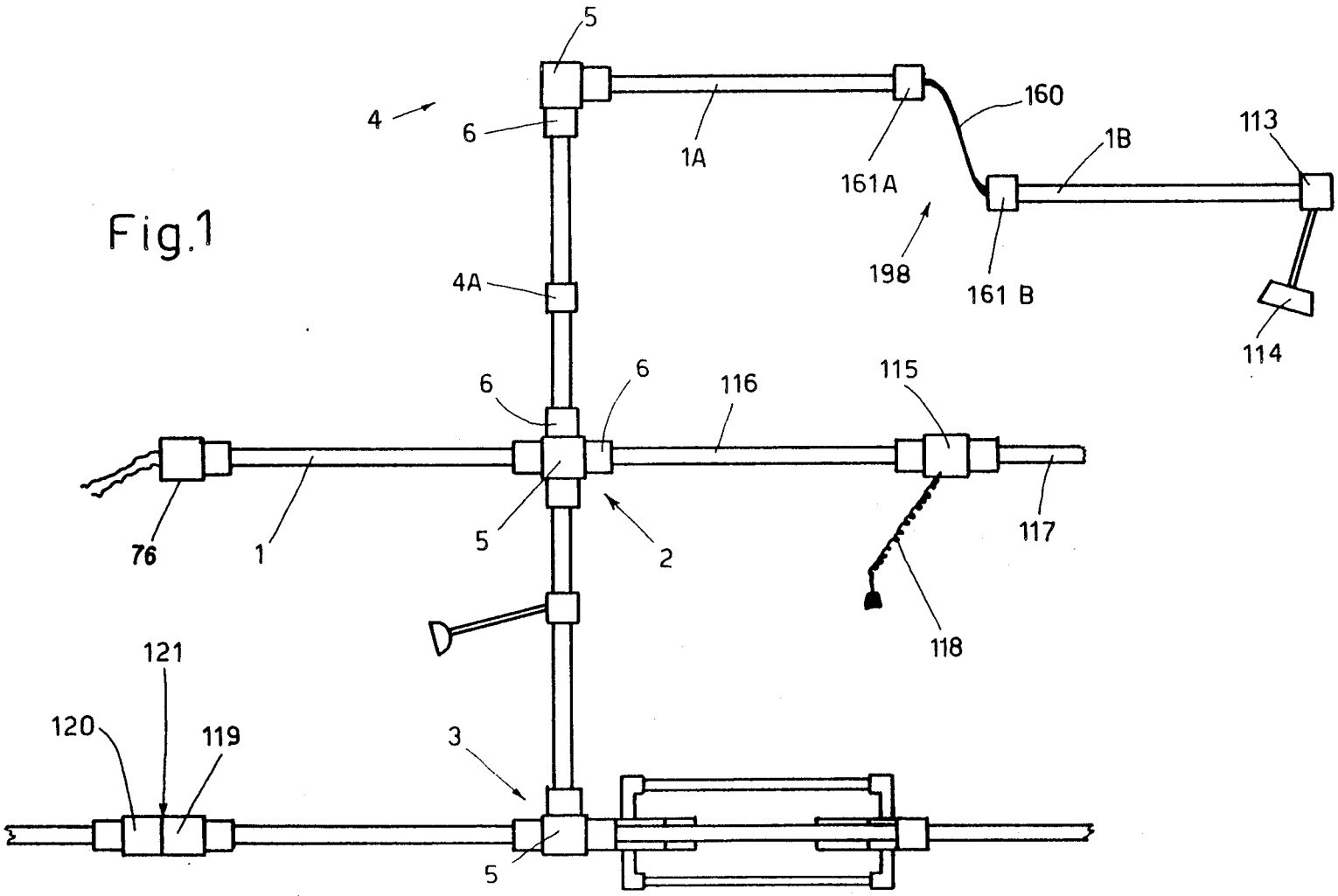
FIG. 1 is a schematic representation of an example of an electrified line which can be built up in modules using the constituent parts of the described system, these parts being illustrated in specific figures.
Figure 6:
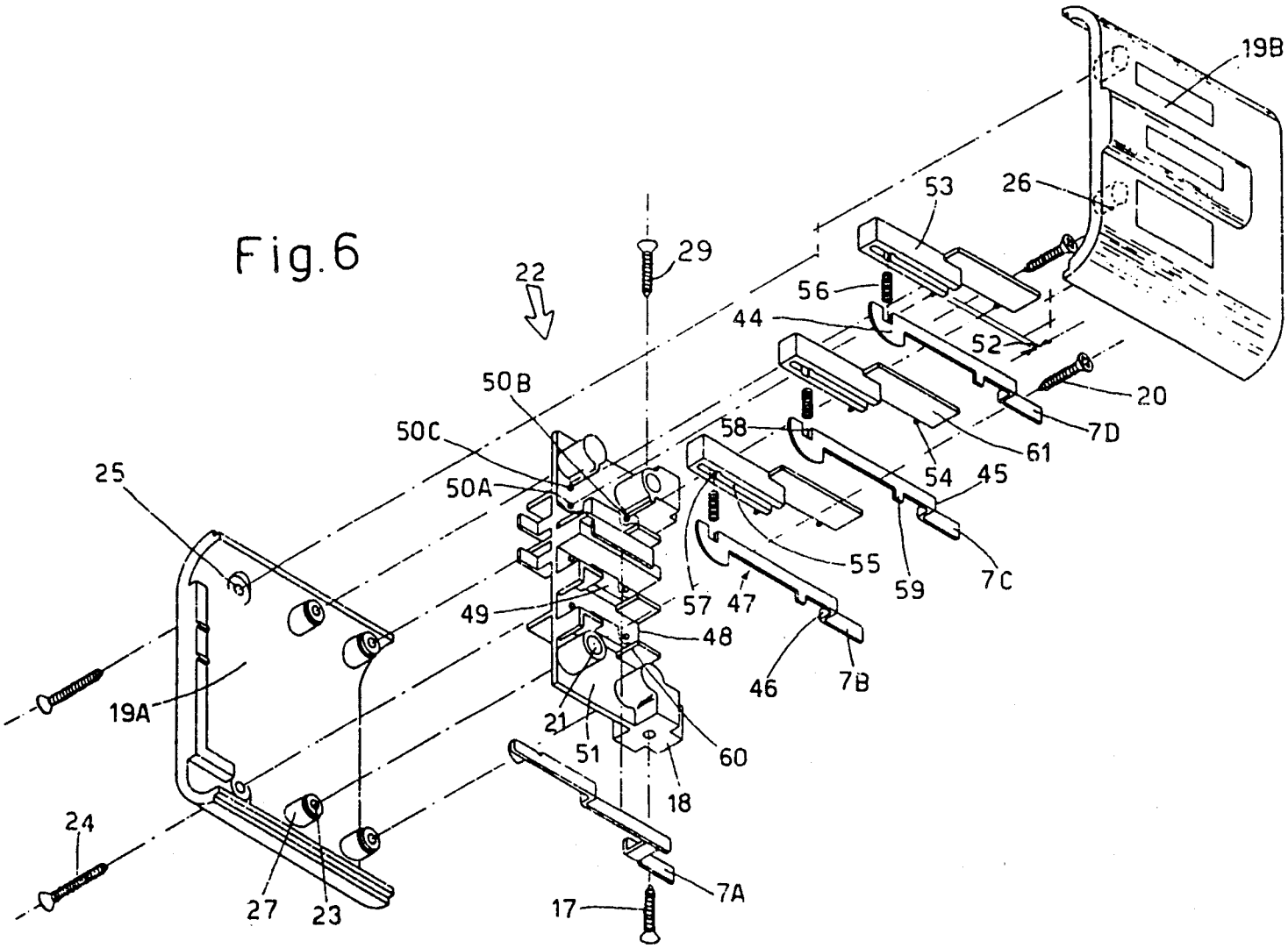
FIG. 6 shows a characteristic flange for the end of the track pieces, to be fitted to the connector of FIG. 4.

With reference to FIG. 1, a plurality of track pieces 1 are arranged to form a cross geometrical configuration 2, a T geometrical configuration 3 and an L geometrical configuration 4. The system is able to form such geometrical configurations by virtue of a particular bayonet connector comprising a prismatic square-based female "node" 5 which can be associated with special end flanges 6 comprising pins 7A, 7B, 7C, 7D of rectangular cross-section (FIG. 6).

Figure 4:
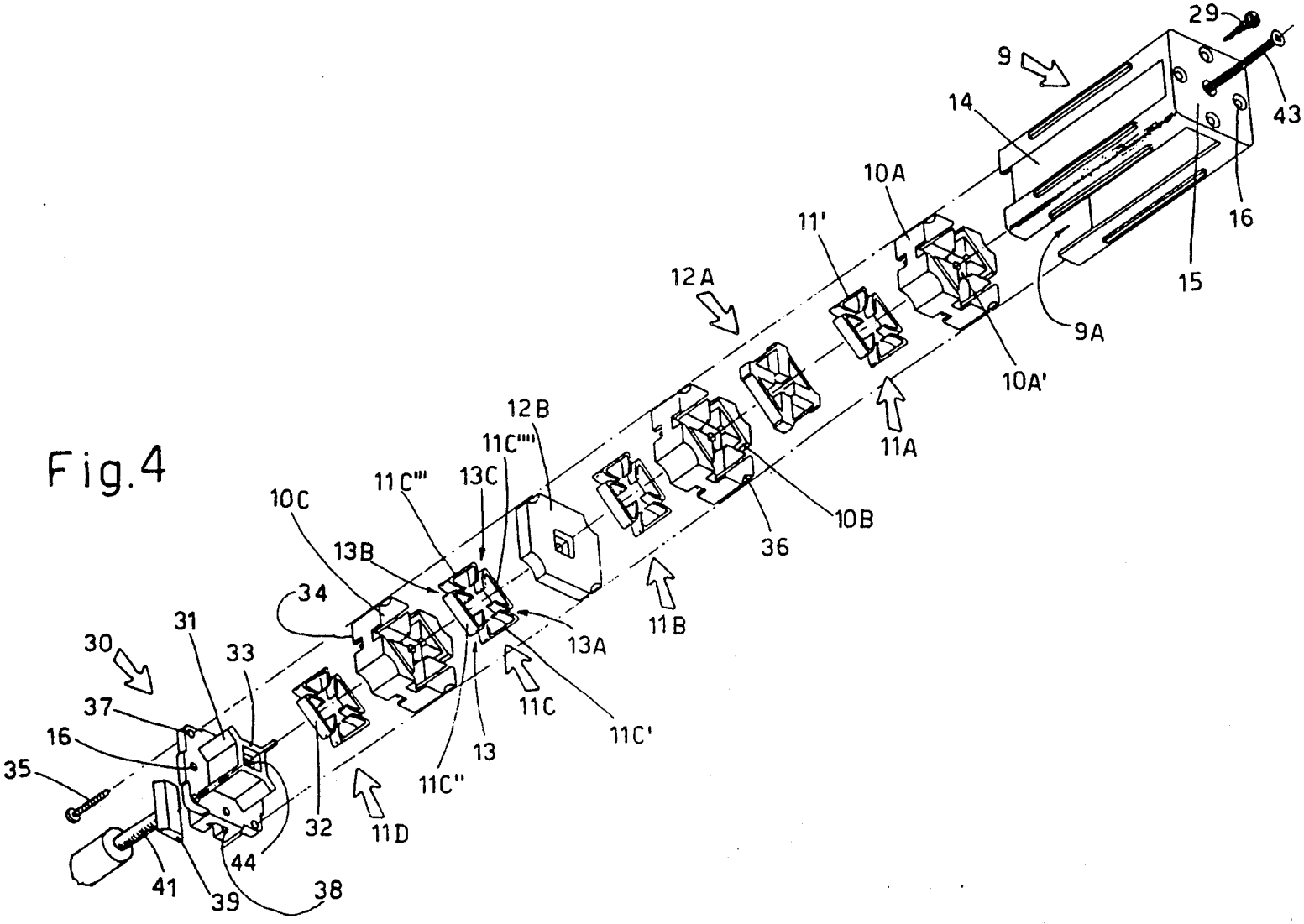
FIG. 4 is a random exploded view of a connector for connecting various track piece lengths or modules together in perpendicular planes.

To understand the characteristics of said female node 5, reference should be made to FIG. 4 which shows it in exploded perspective view.

It consists of a prismatic box 9 of square cross-section open at one of its ends 9A to allow the insertion into its interior of a plurality of layers in the form of first insulating elements 10A, 10B, 10C with seats for receiving profiled conductor layers 11A, 11B, 11C, 11D, plus second insulating elements 12A and 12B acting as spacers. The profiled conductor layers 11A, 11B, 11C, 11D, are all identical, and consist of individual blades 11' which are bent in such a manner that when associated with each other in perpendicular directions they form a shape similar to a quatrefoil. Pins 7A, 7B, 7C, 7D of rectangular cross-section of insert 22 (FIG. 6) are intended to be inserted into corner recesses 13 (i.e. to be inserted between the four "leaves" which form the quatrefoil) defined when two individual blades 11' are placed side by side. In this manner, the two free ends of the individual blades 11' can act in a cantilever manner and thus exert a convenient contact pressure against the sides of the rectangular cross-section of the pins 7A, 7B, 7C, 7D.

As current is provided by conductors present in the track pieces 1, on inserting a pin (such as 7C) into the recess 13 formed by two blades 11C' and 11C'', electricity is made available at both these blades and thus at the other two recesses 13A and 13B which can be used for withdrawing current for a further two possible track pieces. The pins of inserts 22 corresponding to such further track pieces provide continuity in electrical conduction to a further two blades 11C''' and 11C'''', which thus electrify the last recess 13C.

Figure 2:
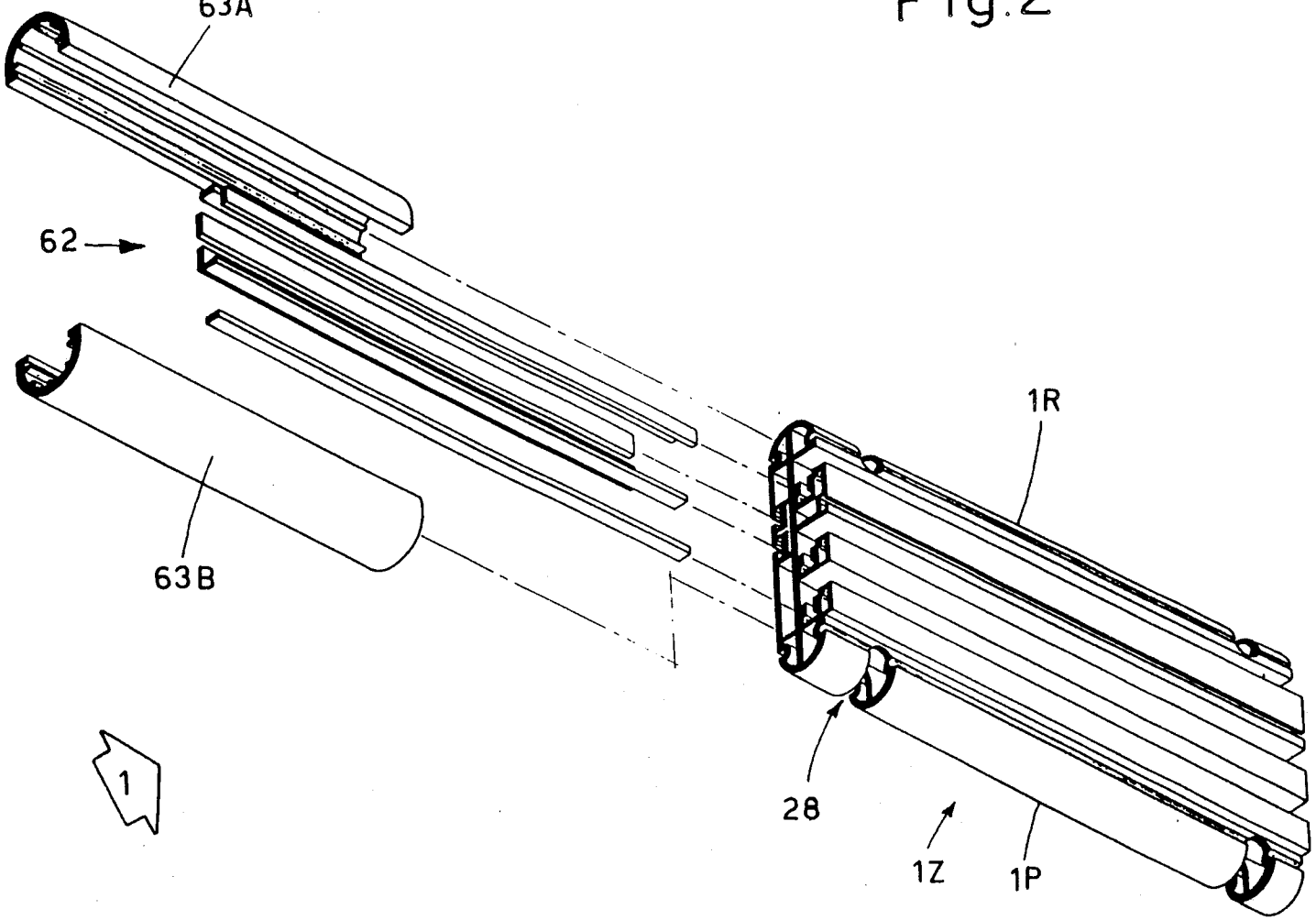
FIG. 2 is an exploded perspective view of an electrified track piece.

One example of the use of the node 5 in this described manner is the cross geometrical configuration 2 of FIG. 1. Node 5 is also designed to be used with the same constituent elements for the other geometrical configurations 3 and 4, and offers the same aesthetic quality and safety as if it had been designed specifically for these configurations. The prismatic box 9 is structured with its rectangular side walls 14 "pieceable" in the sense that they are provided with a predetermined perimetral cut along which a certain strip can be broken off to allow the pins 7A, 7B, 7C, 7D (FIG. 6) projecting from the track piece to gain access to the recesses 13 (FIG. 4). In a central position on the base of the prismatic body there is a bored column (not visible in FIG. 4) which rests via its top end in a square seat 10A' to space the insulating element 10A from the base 15 of the box. This spacing is such as to position the profiled conductors 11A at a distance which cannot be reached by screws 17 (FIG. 6) inserted through holes 16 (FIG. 4) to mechanically fix in a transverse direction plastic stems 18 (FIG. 6) which have been previously fixed to plastic half-boxes 19A, 19B, by tightening screws 20 inserted through holes 23 in the half-box 19A. The purpose of the half-box 19A is to combine with the other half-box 19B by screws 24 inserted from the outside through holes 25 and tightened into plastic columns 26 (identical to the columns 27 of the half-box 19A) indicated in FIG. 6 by dashed lines as they are not visible. The purpose of the columns 26 is to form a retainer to be housed in recesses 28 (FIG. 2) provided in the edges of the ends of each track piece 1.

Summarising, the track piece 1 is fixed to the node 5 in the following manner:

one end of the track piece 1 is fixed to the box 19A–19B by inserting plastic columns 26 into the recesses 28 (FIG. 2) and tightening with the internal screws 24 (FIG. 6);

the box 19A–19B is fixed to the insert 22 by screws 20 inserted through the holes 23 (FIG. 6);

the insert 22 is fixed to the prismatic box 9 (FIG. 4) by screws 29 inserted through the holes 16.

The node 5 shown in exploded view in FIG. 4 is closed by an end plug 30. The inner side of this plug is shaped with four fins 31 which each rest on a corresponding intermediate portion 32 of the four constituent blades of the quatrefoil 11D. The inner side of the plug also comprises a central perimeter 33 for resting against a flat end 34 of the insulating element 10C. In this manner, when the plug 30 is inserted into its seat, corner screws 35 are inserted through holes 37 and into inner corner enlargements on the prismatic box 9 (these not being visible but having a cross-section complementary to those of the corner recesses 36 of the various insulating elements 10A, 10B, 10C, 10D) and then tightened to clamp together all the superposed or layered components contained in the prismatic box 9. The plug 30 is provided externally with a slot 38 of dovetail or undercut shape into which a metal head 39 is inserted, provided with a shank 41 which can be screwed into a support member 40 associated with a steel cable or other means suitable for supporting the node 5 of which the end plug 30 forms part. The slot 38 has a shape or extension such as to enable the shank 41 to exactly assume a central position or one coinciding with the axis 42 of the node. This axis is aligned with that of a screw which passes through central holes in the layered elements to engage a threaded metal bush 44 embedded in the end plug 30. The purpose of the screw 43 is one of safety, to ensure that the weight of the node 5 plus the track pieces connected to it does not result in separation of the node, with the parts suspended from the ceiling falling to the floor.

It is therefore apparent that the node according to the invention has a functionality and a strength which result in considerable advantages.

An "upstream" track piece 1 has been considered, supplying current to the node 5 via its pins 7A, 7B, 7C, 7D. These pins have a special structure which enables them to withdraw or feed current from or to the track piece 1 along which the current is conveyed. The track piece 1 is basically a standardized conductor able to be fitted with different connectors at its ends, depending on its use. A typical advantage of the present invention is that this fitting results not only in mechanical but also in electrical connection, so that it offers maximum assurance of functionality, reliability and mechanical strength. The mechanical connection involves the use of screws in the manner already described. The electrical connection involves the insertion of flat conducting heads 44, integral with the pins 7A, 7B, 7C, 7D by virtue of being produced by punching out a blade 47 from copper or other electrically conducting material (such as aluminium) (FIG. 6).

As can be seen from the perspective view of this figure, the blade has a double bend 45. This bend forms a surface 46 perpendicular to the axis of the blade 47 so that it can rest against a thickened edge 48 of the facing region of a raised portion 49, which has been partly removed in the drawing to expose three holes 50A, 50B, 50C. The raised portion 49 has a height, above a plane 51 of the insert 22, which is equal to the thickness 52 of an edge of a removable seat 53 to rest on the plane 51 with its three pegs 54 inserted into the holes 50A, 50B, 50C. The removable seat 53 is provided with a groove 55 in which the blade 47 is housed so as to be guided in its planar movements, which are made elastic by a spring 56. This spring has one end contained in a cavity 57 formed as an enlargement of the groove 55 and its other end contained in a recess 58 provided in the head 44 of the blade 47. It has been explained how the insert is made rigid with the track piece 1. As the pins 7A, 7B, 7C, 7D are inserted by mechanically maneuvering the track piece 1, it will now be explained how these pins are made rigid with the body of the track piece.

This rigid fixing, deducible from the aforegoing, can be summarised as follows:

a) the removable seat 53 is fixed to the insert 22 by the pegs 54;

b) the spring 56 is partly inserted into the cavity 57 in the removable seat;

c) the thus projecting end of the spring 56 is inserted into the recess 58 in the blade 47;

d) the surface 46 of the blade 47 is rested against the edge 48 of the insert 22.

In this manner, the considerable axial thrusts which the various pins 7A, 7B, 7C, 7D receive by the reaction to their insertion exerted by the node 5 are supported by the contact between the regions 46 and 48. The reactive thrusts deriving from the friction generated by the extraction of said pins from their seats in the node 5 are instead supported by the key action of the specific springs 56. This key action also retains the various blades in their seats, which consist of simple supports formed by the raised portions 49, plus the specific grooves 55 offering transverse restraint. Although this constraint is sufficient to give the pins 7A, 7B, 7C, 7D the necessary reliability, if further resistance to extraction should be considered necessary the blades 47 could comprise a tooth 59 to engage against the edges 60 of separation walls between the various electrical conductors. This separation is made more complete by further walls 61 combined with the removable seat 53.

As clearly shown, the flat head 44 is given the shape of a sledge in order to form inclined edges both to create force components for compressing the springs 56 and to provide gradual sliding insertion against the bare exposed surface of the conductors 62 (FIG. 2) housed in their specific seats in the cross-section of the track piece 1.

Figure 11:
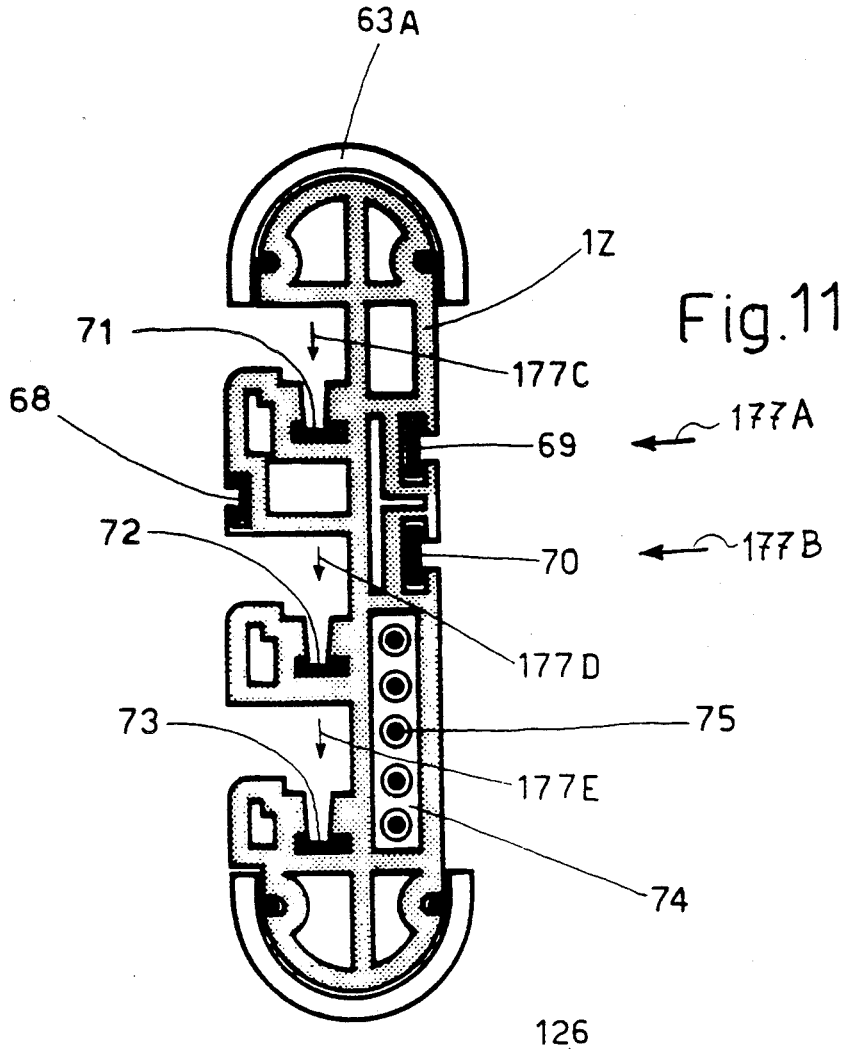
FIG. 11 is a sectional view of a track piece.

In this respect, with reference to FIG. 11 it can be seen that the various conductors consist of bare metal bars housed in positions which are the more unreachable the higher and more dangerous the voltages concerned. Based on this rule, the conductors comprise an earth conductor 68 on one side and two side-by-side conductors 69 and 70 for transferring 12 V electricity on the other side. There are also provided in internal gorges three conductors 71, 72, 73 forming respectively the neutral and two positive phases at line voltage (for example 220 V), to thus provide two 220 V lines which can be used selectively, independently of each other. The various arrows 177A. 177B, 177C, 177D, 177E indicate the direction in which the contact has to be implemented by the various profiled heads 44 of the blades 47. Advantageously, the track piece is also provided with a compartment 74 for the possible passage of large-diameter covered or sheathed conductors 75.

Figure 5:
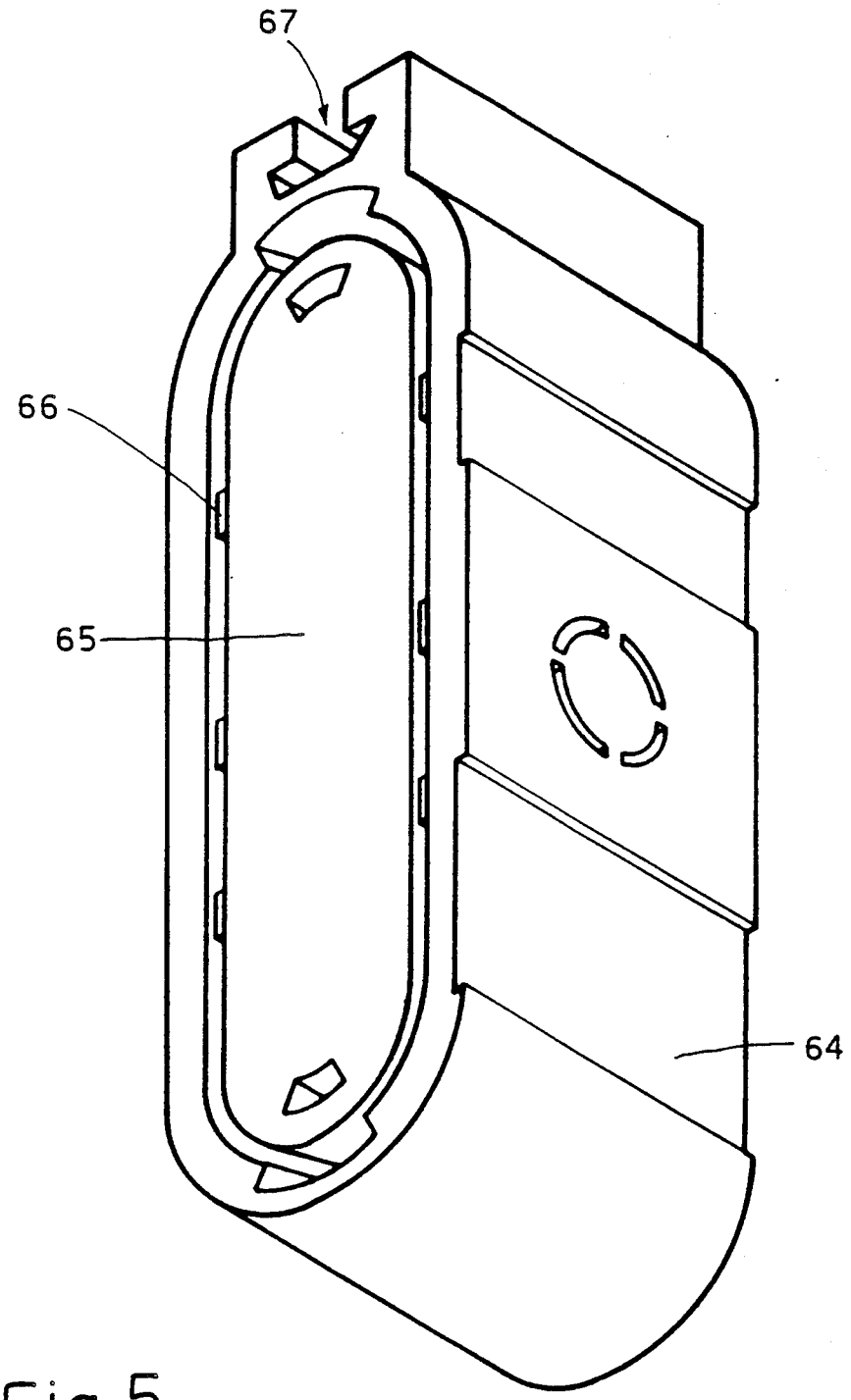
FIG. 5 is an end or intermediate support for a track piece.

The track piece 1 consists of a plastic extrusion 1Z having edges 1P, 1R (FIG. 2) marrying with metal profiled strips 63A, 63B, to form an assembly of greater mechanical resistance to bending, or to give the track piece a greater rigidity and therefore straightness, to enhance the appearance of the system. Thus track pieces of a suitable length enabling them to be supported only at their ends can be used, and thus without the need for intermediate supports 64 of the type shown in FIG. 5. The supports 64 embrace the entire profile of the track piece and in addition are cup shaped with one of their end walls 65 removable by pulling tear-off tabs 66. In this manner they can be used either as a free end for a track piece or as an intermediate support for it. As in the case of the node 5 and other parts for fitting to the ends of the track piece, these supports are also provided with an undercut slot 67 for engagement with suspension means, for example similar to the metal head 39 with the threaded shank 41 inserted into its support body 40 (see FIG. 4).

From the aforegoing it is apparent how contact is achieved between the conductors 68, 69, 70, 71, 72, 73 and the heads 44 of the respective blades 47. However, to understand how the mains current reaches the initial track piece, reference should be made to FIG. 3, which shows the components of an entry box 76. This box consists of a central body 76A associated with a first cover 76C, a second cover 76B and a third cover 76D. The first cover 76C faces a compartment 76E where line voltage (220 V) is present, whereas the third cover 76D faces a compartment 76F where a voltage of 12 V is present. A first conductor 77 is led into one or other of said compartments through a single hole 78 in a position corresponding with a separation wall 79 having an aperture 80 through which the first conductor 77 gains access to the required compartment by being bent to one side or the other. When said first conductor has been positioned in one of these two compartments, the aperture is closed by a cover 81 fixed by usual engagement means passing into holes 82 in the separation wall 79 and located in the other of the two compartments 76E or 76F. The separation wall 79 comprises column projections 83 on both its faces, for insertion into usual holes in mains voltage terminal blocks 84 or low voltage terminal blocks 85. In the case of mains voltage terminal blocks comprising an earth, neutral and two phases, three holes are available for association with the three indicated column projections 83. In the case of low voltage terminal blocks (usually 12 V) to which only two conductors of the track piece are connected, there is only one central hole 86 available, so that the respective side of the separation wall comprises only one column projection (not visible in FIG. 3). Electric wires 87 then extend from these terminal blocks to screws 88 which clamp them to blades 89 having a structure equivalent to the blades 47 of FIG. 6. Thus with this connection method the current arriving from the first conductor 77 reaches the heads 89A of blades 89, to be available to pass to the straight conductors housed in the track pieces when combined with or inserted into them.

Figure 3:
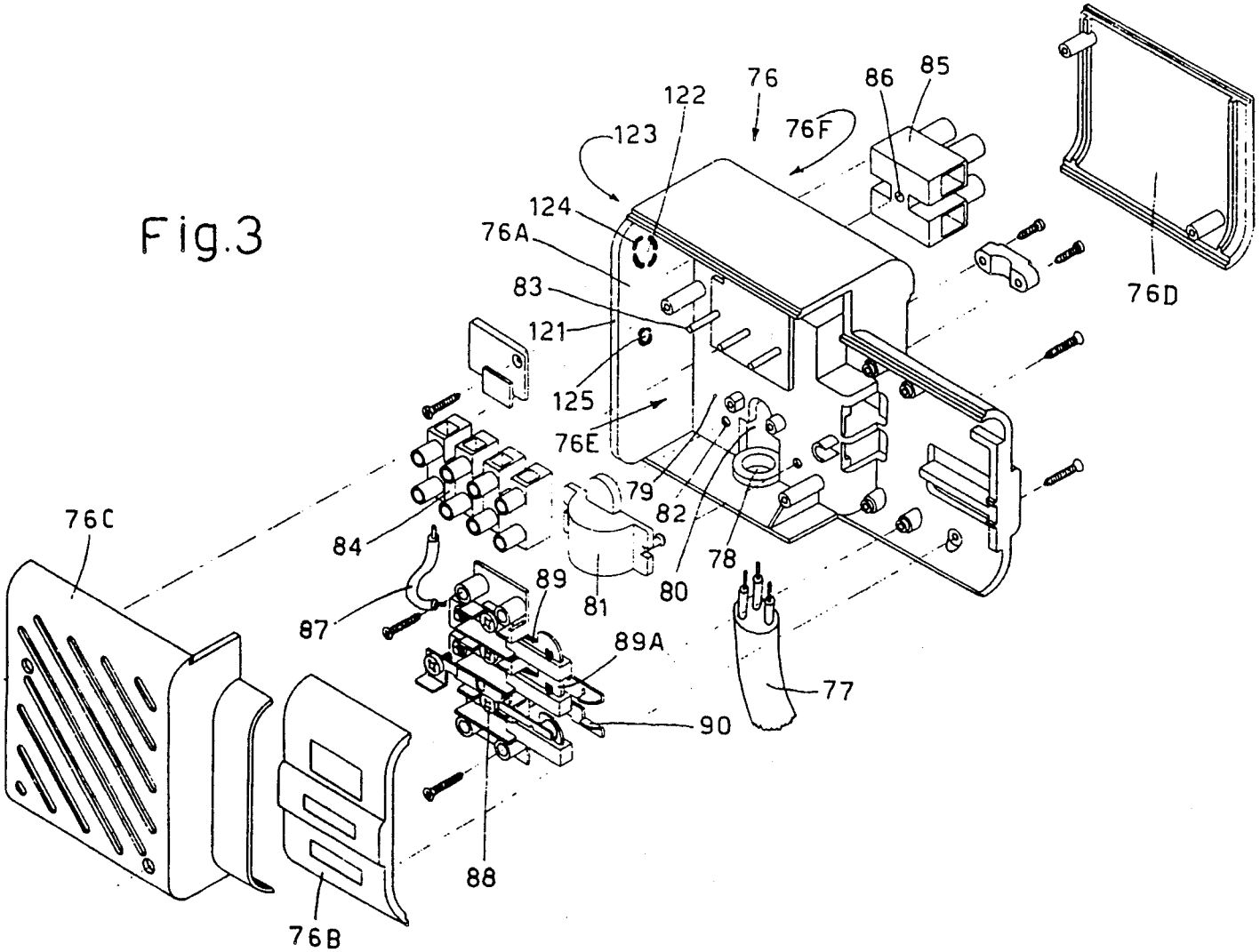
FIG. 3 shows in random arrangement a box for feeding the end of the line.

FIG. 3 shows a box 76 known as an "entry" box, however this definition is used merely to simplify the description. In fact the same box could be used as an end box 113 (FIG. 1), from which a user appliance 114 extends. It could also be used as a box 115 for connecting together two track pieces 116 and 117 from which a current socket 118 extends, or to which a source of electric current could be connected to commence electrification of the described system, and of which FIG. 1 represents a simple geometrical example. The double box 115 is in fact a box identical to the box of FIG. 3 except that it is provided with connectors for two track pieces instead of for just one as indicated in FIG. 3. The electrification reaching or leaving this box can be of low voltage and/or of mains voltage (220 V) type. The particular structure of this type of box enables entries or exits for different currents to be provided at any point along the system, in the sense that a system, for example a 220 V system, can also be entered with a 12 V voltage to electrify only selective parts of it.

A further characteristic illustrating the versatility of said box is that it can be associated with another identical but specular box, i.e. a combination of a right hand box 119 and a left hand box 120 (FIG. 1). These types of boxes have a wall 121 (FIG. 3) which marries with the equivalent wall of the other box. For this reason, this wall is provided with a hole 122 for each of the two compartments 76E and 76F. These two holes are identical but are surrounded on the outside 123 of the wall 121 one with a projecting circular ring and the other with an equal annular recess, to form male-female elements to be engaged with similar female-male elements on the wall 121 of the other box (119 or 120) with which it has to combine. The holes 122 are defined by through arcuate slots 124 which interrupt the continuity of the hole circularity by leaving intermediate full parts which can be easily broken manually, so as not to expose the holes when their use is not required, i.e. before said breakage. The two boxes 119 and 120 are joined together by two through screws with nuts, using holes 125 below each of the two holes 122 provided in the two compartments. This combination makes it possible to advantageously separate the two types of electrical supply even more rigorously.

FIG. 3 shows the blade heads 90 bent perpendicular to their plane of elastic flexure. This is because of the different positions of the planes in which electrical contact is established within the group of straight mains conductors 71, 72, 73 and the group of low voltage conductors 69, 70 and the earth 68. Bending the heads 90 enables the rectangular-section blades of which they form part to be subjected to flexure in a plane involving a lesser moment of inertia. This enables them to undergo greater elastic deformation for equal stressing, thus not requiring the action of specific helical springs, as instead are required by the blades 47.

Figure 9:
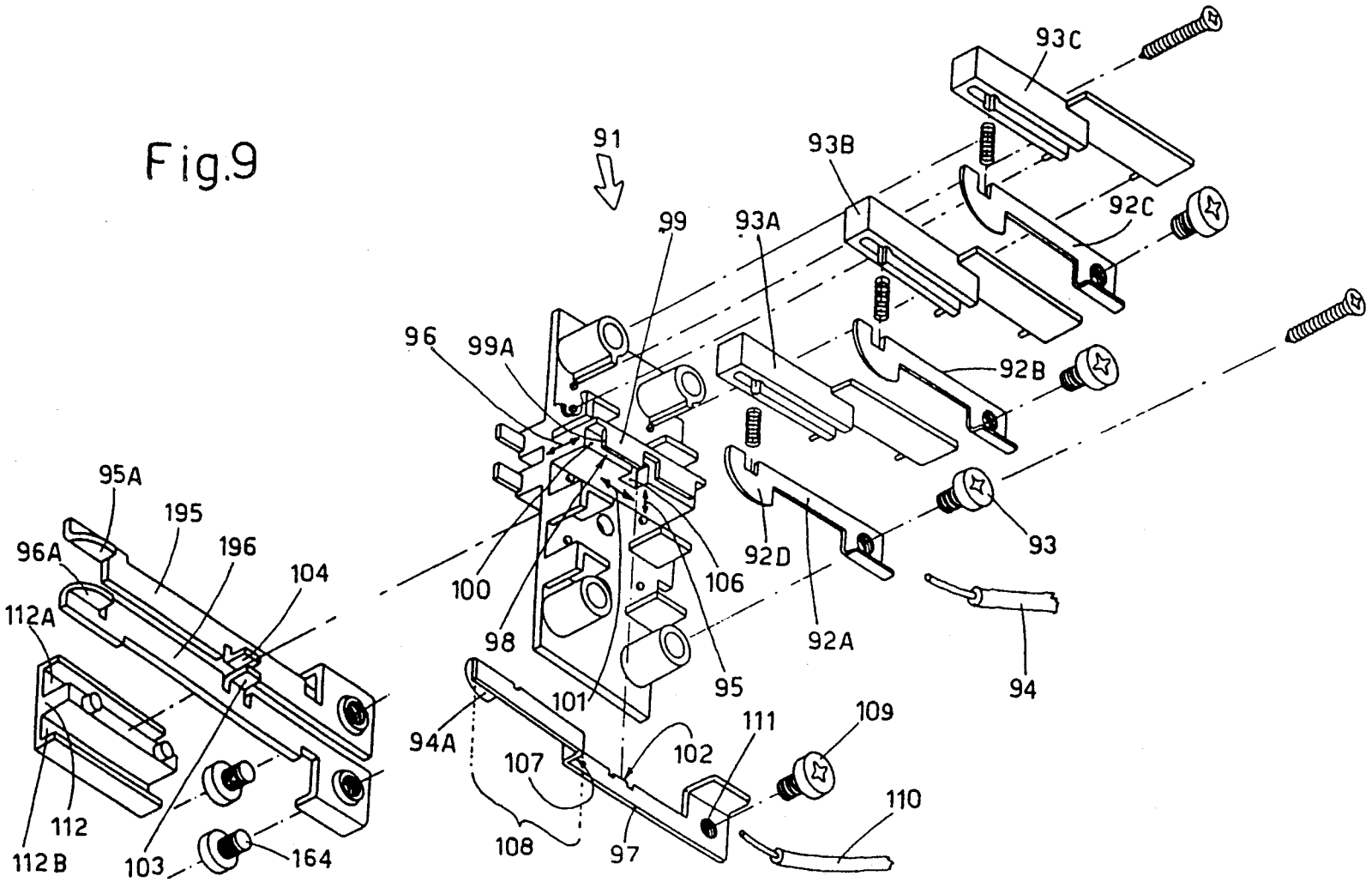
FIG. 9 is an exploded view of an element for establishing contact with both the mains voltage (220 V) conductors and the low voltage (12 V) conductors present in the track piece.

The particular method of fixing these bent-head blades is shown in FIG. 9, in which an insert 91, equivalent to the insert 22 of FIG. 6, is shown in exploded view with blades 92A, 92B, 92C associated with their removable seats 93A, 93B, 93C identical to the seats 53 of FIG. 6, for easier understanding. In said FIG. 9, the blades 92 are without the pins 7A, 7B, 7C, 7D. In fact, in this configuration the electric current reaches the heads 92D via usual electric cables clamped by screws 93. Again via electric cables the electric current reaches or leaves bent-head blades 97 (for earthing), 95 and 96 (for low voltage current).

These bent-head blades have a configuration and method of fixing different from the blades 92A, 92B, 92C to obtain elastic yielding of their bent heads 94A, 95A, 96A as a result of bending of their actual structure. Their fixing to the insert 91 is by friction by inserting their width 97 into a seat 98 defined by ledges 99 integral with the plastic structure of the insert 91 and having a certain flexural yieldability which both facilitates the edgewise introduction of the blade 97 and is sufficient to then retain it in situ. This retention is valid only for the insertion-extraction direction 95.

In a further two directions 96 there is positive engagement with the ledge 99 and with a support surface 100.

In the remaining directions 101 the blade is retained by the engagement of a tooth 102. This tooth is bent and is therefore only partly visible.

Its shape however can be clearly seen in that it is identical to teeth 103 and 104 of a further two inverted blades 195 and 196 engaged analogously in seats present in a lower part 105 of the insert 91.

The purpose of the tooth 102 is to engage in a cavity 106, preventing it moving in the directions of the arrows 101. The blade 97 comprises a double bend to create a surface 107 resting against an edge 99A of the ledge 99, so that the free "projecting" length of the blade 97 is a distance 108. The blade 97 is further fixable by the action of a screw 109 which clamps an electric cable 110 against it and has that portion projecting beyond a threaded hole 111 in the blade slackly inserted in a seat to provide transverse restraint. The ledges can be formed directly by moulding as only one transverse access (directions 95) is required because of the presence of only one blade 97, however they cannot be formed in this manner if there are two blades to be inserted, such as the pair of low voltage blades 195 and 196. In this case, ledges 112A and 112B serving an equivalent purpose as the ledges 99 are added lowerly by means of an insertable element 112 which defines them.

The system of the invention comprises fluorescent tube supports in the form of a structure which not only provides an overall integrated appearance but also a considerable mechanical and electrical reliability, for an economical production cost. These supports include a length of track piece and are thus in the form of modules which can be freely combined in accordance with any functionally and aesthetically desired geometrical configuration.

Figure 10:
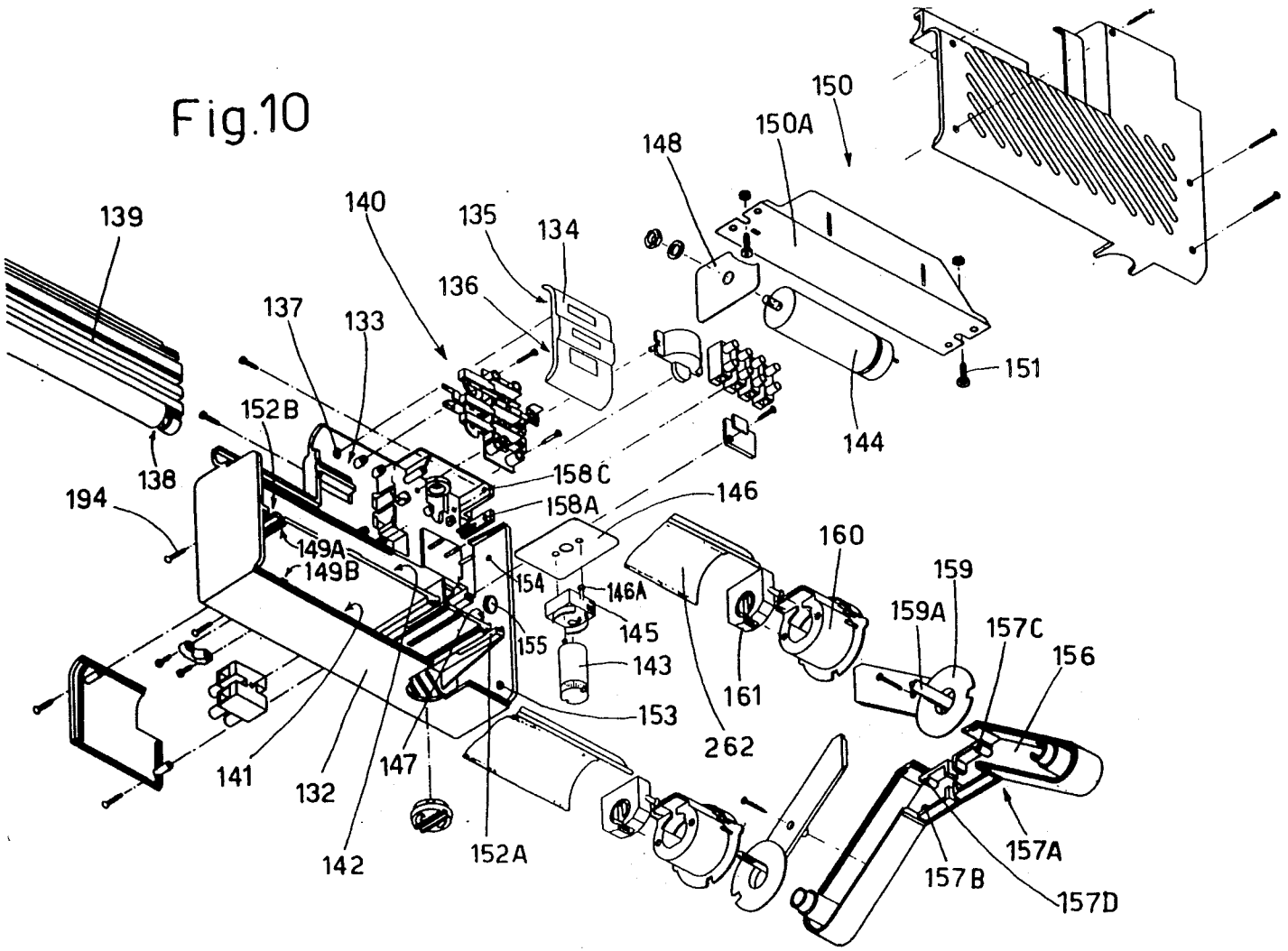
FIG. 10 is an exploded view of the constituent elements of a feed and support box for fluorescent tubes.
Figure 12:
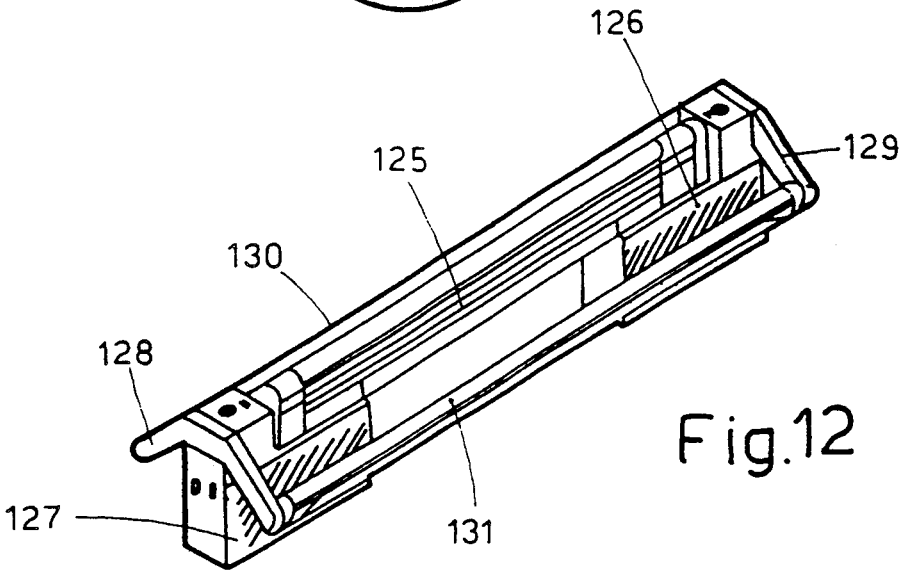
FIG. 12 is a perspective view of a module comprising a pair of fluorescent tubes.

With reference to FIG. 12, a length of track piece 125 has its ends associated with a right hand casing 126 and a left hand casing 127. These casings comprise forked supports 128 and 129 for retaining fluorescent tubes 130 and 131. The constituent parts of these casings are shown in the exploded view of FIG. 10. In this a base box 132 is provided lowerly with a region 133 which can be closed by a cover 134 provided with internal columns, not visible, in regions indicated by the arrows 135 and 136. The column in the region 135, for example, is aligned with a circular recess 137 against which it rests. The cover 134 is clamped against the base box 132 by self-tapping screws 194 inserted through holes in the centre of the recess 137 and in the centre of said columns, which are not shown but are identical to the columns 26 already described with reference to FIG. 6. As in the case of these latter, the present columns are intended for insertion into recesses 138 milled out of the edges of a length of track piece 139. This means that the end of the track piece is housed only partially in the region 133. The remaining space available in this region is for housing an electrical contact unit 140 analogous to that described in relation to FIG. 9 or FIG. 3. The lower part of the box 132 is in effect a specific version of the box of FIG. 3, but combined with a further upper box member 142 and lower box member 141 which are used for housing transformers for converting the line voltage (e.g., 220 V) into lower voltage (e.g., 12 V) or for housing other electrical or electronic components required for the operation of the fluorescent tubes, in particular a starter 143 or capacitor 144. The starter is mounted on a base 145 by usual bayonet insertion. This base is fixed to a metal plate 146 by snap-engaging elastically flexible pegs 146A into its holes. The plate 146 is mounted by sliding into suitable grooves 147. In a similar manner a metal plate 148 is inserted, on which the capacitor is fixed by screwing. However, for space reasons the plate 148 is positioned perpendicular to the plate 146, by being slid into grooves 149A, 149B extending in a vertical plane.

A transformer 150 (known as the feeder) already mounted on a metal base 150A is located in the box member 142 and fixed by screws 151 screwed into two slots 152A and 152B, so solving the difficult problem of forming holes in the dividing wall between the two said box members 141 and 142.

The base box 132 is provided at the sides of its end surface 153 with holes 154 for fixing to it a box containing a connection for the track piece 1, if this fluorescent tube lighting module is not located in an end position of the system geometrical configuration. The box 132 is therefore structured to enable it to be joined to another box, for example of the type shown in FIG. 3, or to another specular base box 132, to align two modules and provide continuity for the lighting line for which they are intended. For this reason, the box 132 is also provided with a pair of break-off holes 155 which can marry with holes of the 122 type of the adjacent box used, possibly by means of the recess arrangement already described for FIG. 3.

The fluorescent tube support is implemented by using a fork 156 removable from the base box 132 by being fixed by screws passing through four holes 157A, 157B, 157C, 157D which mate with four corresponding holes, of which only the holes 158A and 158C in the pegs of the base box 132 are visible. In this manner the weight of fluorescent tubes acting on said fork is supported. The fact that the forks 156 can be removed in the stated direction (along the axes of the supported fluorescent tubes) has the advantage that a continuity of elements 159–160–161–262 can be assembled between two opposing forks 156. In this manner a diffuser plate 162 or other types of screen serving the same purpose can be rotated about the axis of alignment of these elements (coinciding with that of the fluorescent tube). This removability makes it possible to torsionally fix the support element 160 for a fluorescent tube connector 161 by means of a key 159A on a cover 159 fixed to the fork 156, this torsional fixing being required both because of the need to be able to manually rotate the screen 262 and because of the need to be able to manoeuvre the fluorescent tube itself by means of the usual bayonet movements during its fitting and removal. The removability of the forks 156 offers the advantage of being able to also use the base box 132 for containing other components in its box members 141 and 142 without aesthetically detracting from its main purpose of supporting fluorescent tubes. This facility for removing the forks from the rest of the system offers the further advantage of allowing it a multiplicity of architectural and aesthetic combinations, including multicoloured, while using practically only the same component parts, and changing the colour and shape only of said forks and the auxiliary parts associated with them.

Figure 7:
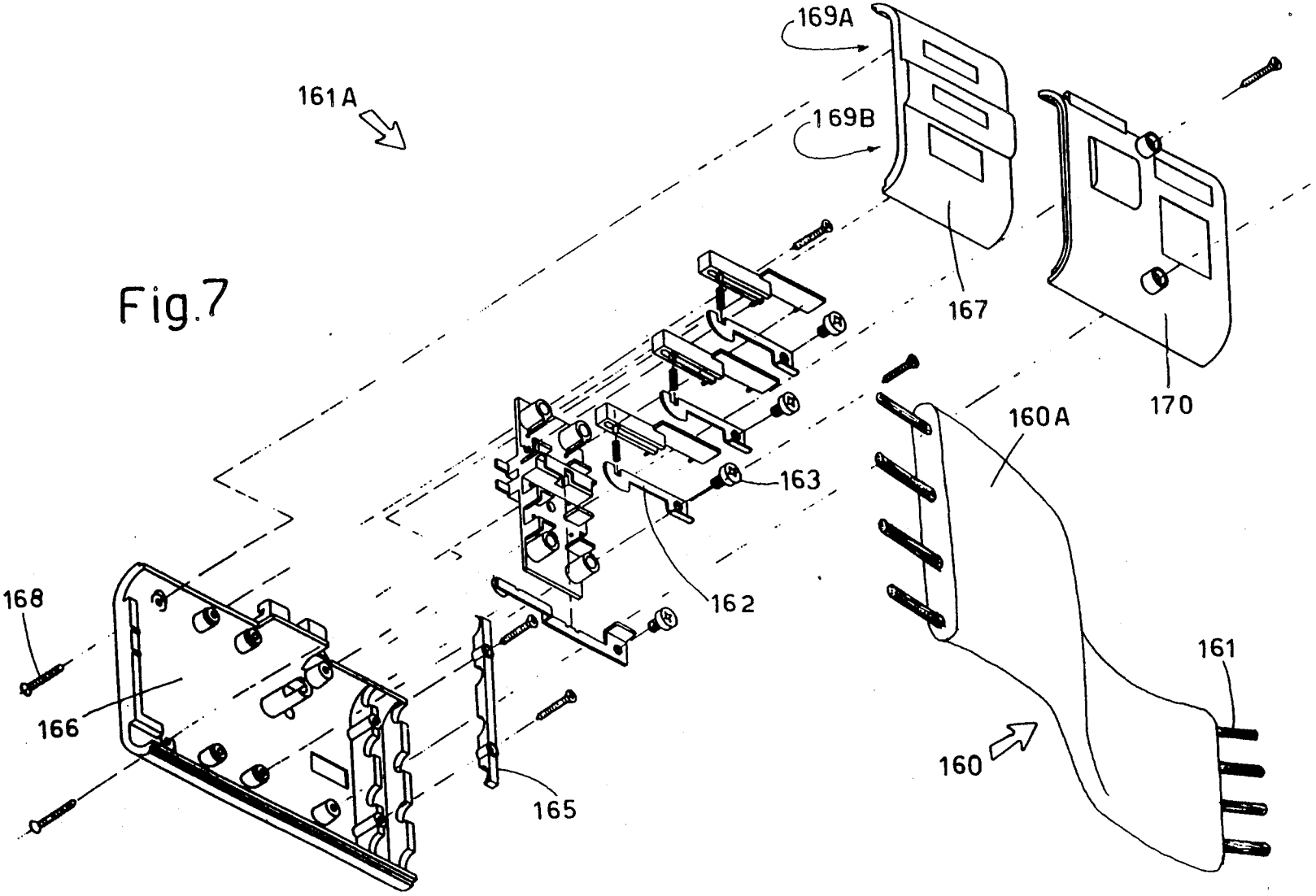
FIG. 7 shows a flange for forming a flexible connection between two track pieces.

Referring to the ability of the system to provide electrical and architectural continuity in any direction, such as the flexible connection of the portion 198 of FIG. 1, this is attained by using a pair of right hand and left hand flanges 161A and 161B of the type shown in the exploded view of FIG. 7. These flanges are connected together by a flexible band 160 comprising a plurality of electric cables placed side by side in an insulating sheath.

This figure shows that contact blades 162 of the type already shown in FIG. 9 are used. For reasons of improved clarity, the blades of the type 95 and 96 for low voltage current are not shown, although there is nothing to prevent their use. The flexible band 160 comprises electric cables, the bare ends of which are clamped by usual terminal screws 163, identical to other terminal screws 164 for the low voltage blades 195 and 196 of FIG. 9. The ends 160A of the band 160 are clamped to the specific flange 166 by a long cable clamping bar 165. The flanges 161A and 161B (FIG. 1) have one of their sides 166 (FIG. 7) constructed in one piece, whereas their other side is in two pieces forming two covers 167 and 170. The cover 167 can be fixed by screws 168 passing through columns positioned in the regions 169A and 169B, to screw into the recesses 28 in the edges of the track pieces 1 (FIG. 2) in the manner already described in relation to FIGS. 6 and 10. The cover 167 mainly concerns the mechanical aspect of this flexible connection, whereas the cover 170 mainly concerns the electrical part of this connection section, in the sense that the section can comprise the flexible flange 160 already mounted on the two end flanges 161A and 161B, the final or complete connection to the adjacent track pieces 1A and 1B (FIG. 1) then being made by removing only the covers 167. Again, with the flexible section 160 already installed, the electrical connections can be checked or changed by simply removing the cover 170.

Figure 8:
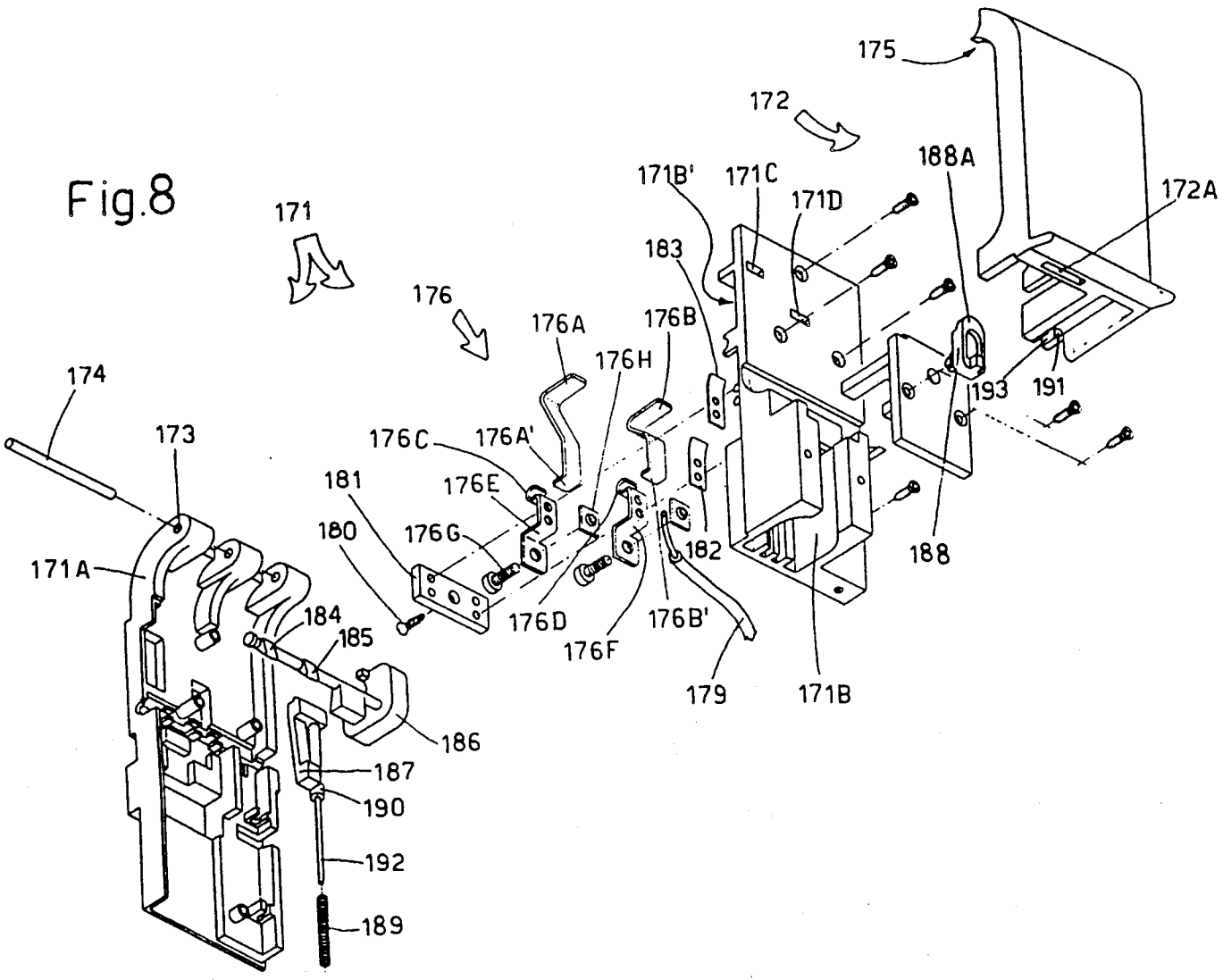
FIG. 8 shows a device for fixing user appliances in intermediate positions on the track piece and for enabling these appliances to withdraw the 12 V current.

The particular arrangement of the bare conductors within the track piece 1, in an innermost position but one which is accessible from the outside, and the original connection of the double-voltage, double-phase track piece, have meant that special current withdrawal methods have had to be designed which not only provide proper electrical and mechanical operability but also guarantee the absolute safety required of electrical distribution systems in habitable environments. These special withdrawal means are shown in FIG. 8.

This figure shows a box for withdrawing current from the two low voltage (12 V) conductors 69 and 70, their position in the cross-section of the track piece being visible in FIG. 11, this being a directly exposed position in view of the intrinsic safety of low voltage, and determining a configuration of the withdrawal accessory or box (FIG. 8) which prevents any accidental electrical contact between this latter and parts at mains voltage. The earth conductor 68 has a similar exposed position, to allow direct access to the conductor for immediate testing for any electrical dispersion using a meter, or for testing for absence of current in the stated conductors.

This box consists of two parts 171 and 172 hinged together to clamp an intermediate piece of track piece. The part 171 comprises an outer member 171A comprising female seats 173 for housing a pin 174 to be inserted into like female seats in a complementary offset position 175, which is not visible and is therefore indicated by an arrow. Thus the hinging takes place between the outer member 171A and the other part 172.

The part 171 also comprises a plate of complex geometry 171B enclosing an electromechanical switch 176. This switch is composed of hoe-shaped blades 176A and 176B which by a movement in the direction of the arrows 177A and 177B (FIG. 11) are inserted through slots 171C and 171D in the plate 171 until they project from it to make contact with the conductors 69 and 70.

The ends 176A' and 176B' of the two said blades are curved in the opposite direction to that already described, so that they can be swivel-inserted into respective seats 176C and 176D of other electrically conducting profiled blades 176E and 176F provided with screws 176G and clamping plates 176H for electric cables 178 and 179.

The blades 176E and 176F are fixed against the rear side 171B' of the complex geometry plate by a screw 180 acting on a plate 181. This fixing involves interposing preferably phosphor-bronze strips 182 and 183 between the blades 176A, 176B and the wall 171B', this electrically conducting alloy being chosen because of its suitable mechanical elasticity. The purpose of these strips is to prevent the hoe-shaped ends of the blades 176A and 176B from projecting through their slots 171C and 171D.

Their projection for establishing the electrical contact with the conductors 69 and 70 is achieved by the action of specific cams 184 and 185, operated by rotating a knob 186 guided by suitable seats provided in the inner side 171B', which is shaped by known methods to receive the aforesaid parts. The part 172 is kept locked over the track piece to the rear of the plate 171B by a key 188, which is rotated to insert its end 188A into a slot 172A. Besides the directly operable external key, there is a second internal key 187 which is operated indirectly by the knob 186 on adjusting the angular position of the cams 184 and 185. When this knob is in the position in which the cams are disengaged to allow the blades 176A and 176B to elastically retract, a spring 189 keeps a cylindrical head 190 outside a conjugate seat 191 in the part 172 in which it is engaged. In this situation, the part 172 can be freely lifted by rotating it about its pin 174, as inside the conjugate seat 191 there is not only the head 190 but also its shank 192, thus allowing the part 172 to be lifted while remaining within an open slot 193 having a width greater than the diameter of the shank 192.

In contrast, when the knob 186 is rotated to engage its cams 184 and 185 and cause the hoe-shaped parts of the blades 176A and 176B to project and thus make contact with the conductors 69 and 70, it shifts the internal key 187 to overcome the opposing action of the spring 189 and insert the head 190 into its conjugate seat 191 in the part 172, thus preventing lifting because the head 190 is of greater diameter than the width of the open slot 193.

Figure 13:
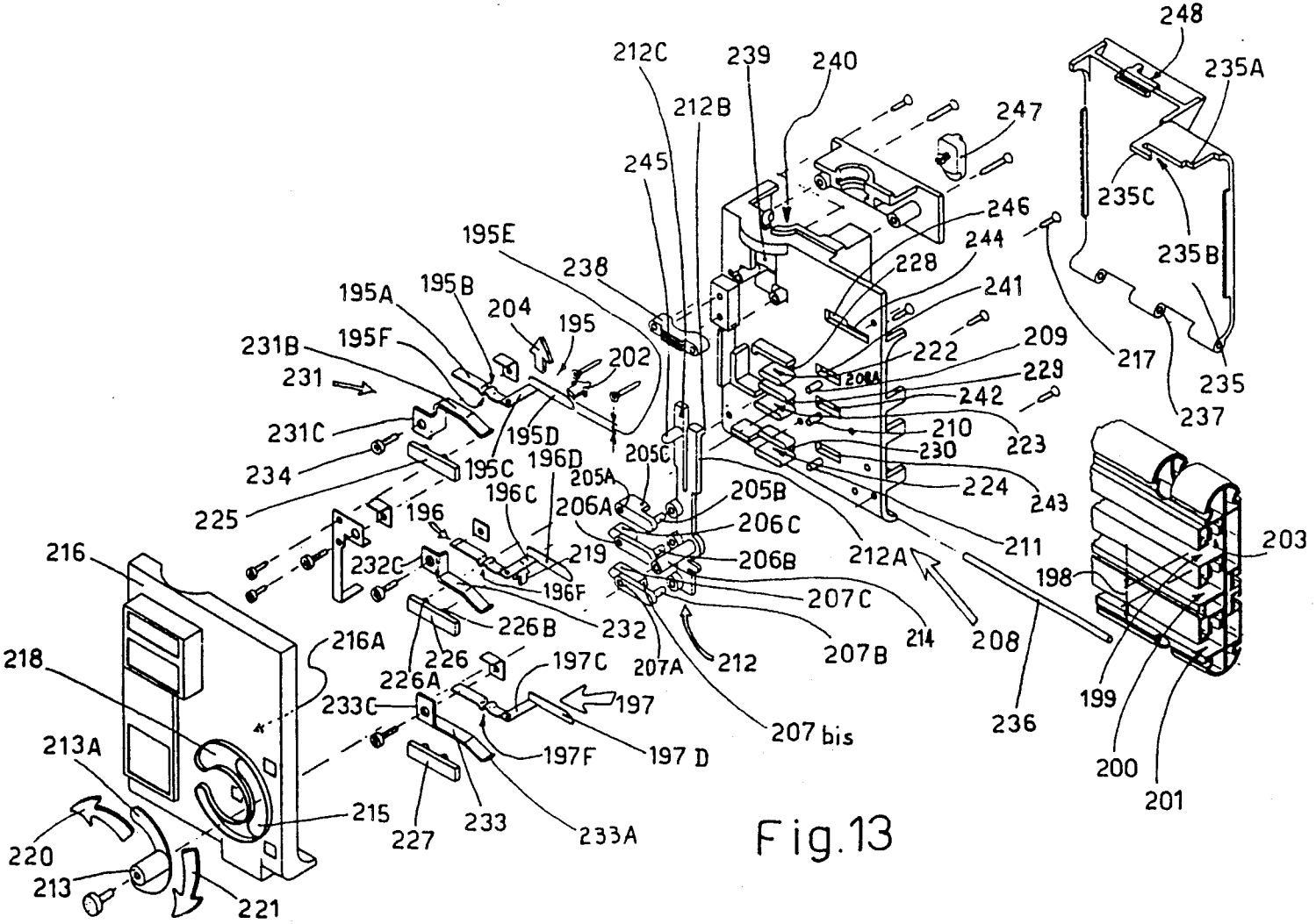
FIG. 13 is a random perspective exploded view showing the constituent parts of a device for the selective withdrawal of mains current (220 V).

FIG. 13 shows the constructional details of a box device which can be locked securely about any region of the track piece, even if already installed, to support a user appliance and also selectively withdraw its required current from one of the two available mains electricity lines (220 V) (theoretically, if required, said current could be fed instead of being withdrawn). The track piece comprises three conductors 71A, 72A, 73A, one of which (for example 73A) represents the common neutral, and the other two (71A, 72A) represent separate phases (73A-72A, 73A-71A), available depending on which of the other two conductors is connected to the neutral conductor.

These conductors are "touched" by copper (or other equivalent metal) blades 195, 196, 197 shaped to extend along the three geometrical axes in accordance with the following geometry: a first longitudinally extending portion 195A lying in a horizontal plane and comprising a recess 195B; a second transversely extending portion 195C lying in the same horizontal plane as the portion 195A to form an L shape, to allow its insertion and seating in holes 241, 242, 243 and reach the region in which the track piece is present; and a third longitudinally extending portion 195D lying in a vertical plane.

This third portion has a width 195E slightly less than the width 198 of the slots 199, 200, 201 so that it can be inserted into their interior with a movement in the direction of the arrow 202. However, as the conductors 71A, 72A, 73A are located elsewhere, in order to make electrical contact with them the portion 195D (and the analogous portions 196D and 197D) must pass vertically along an internal channel 203, i.e. also moving in the direction indicated by the arrow 204. The movement 202 derives from the manual clamping of the box device, whereas the movement 204 is determined by the action of cams 205C, 206C, 207C associated with the blades 195, 196, 197 respectively. These cams are pivoted on a half-casing 208 provided with pins 209, 210, 211 to be inserted in holes 205A, 206A, 207A in said cams. These cams are moved angularly by the angular movement of their pins 205B, 206B, 207B which are joined together by a connecting bar 212 moved parallel to itself as part of an articulated quadrilateral. This connecting bar is operated from the outside by a drilled knob 213 fixed to a pin 214 of the connecting rod and projecting to the outside of the box device passing through a circular slot 215 in a protection cover 216 screwed to the half-casing 208 by a plurality of screws 217. The drilled knob 213 has an arcuate base 213A which slides angularly within a circuit cavity 218 to cover the slot 215 in any operating position assumed by the drilled knob 213 or pin 214. As can be seen from their perspective representation, the cams 205C, 206C and 207C differ from each other. Particular differences in terms of the parts projecting from their pivoting hole 205A, 206A, 207A can be seen. Is this respect, the cam 205 is positioned to the right (with reference to the drawing) of its hole, the cam 206 is positioned to the left of its hole, and the cam 207 is associated with a further cam **207*b* and is therefore positioned to both the left and right of its hole 207A. These cams act on the horizontal-transverse portion of the various conducting blades (such as 195C of the blade 195) in the manner illustrated by the arrow 192**.

When the box device is in its assembled and clamped condition, each cam 205C, 206C, 207C is therefore in contact with a respective blade portion 196C, 196C, 197C.

This determines the following operating configurations:

On moving the knob 213 to its end of travel in the direction of the arrows 220, the cams **207*b* and 205C operate; on moving the knob to its end of travel in the direction of the arrow 221, the cams 207C and 206C operate; on setting the knob in an intermediate position between the stated end positions, the various sections 196C, 196C, 197C are made to rest on the non-eccentric portions of said cams, the various blades thus assuming a "rest" position in which they are separated from the conductors 71, 72, 73 present in the track piece (see also FIG. 11**).

This separation is achieved by an elastic return force exerted on the blades 195, 196, 197 by auxiliary means, or by an intrinsic structural arrangement. This is the case shown on the drawing, from which it can be seen that the blades undergo their return movement by virtue of their flexural-torsional elasticity. In this respect, the blades are fitted into seats 222, 223, 224 and retained in these by plastic bars 225, 226, 227 fixed into said seats by the engagement of pairs of pins such as 226A-226B in corresponding holes in the half-casing 208. Three pairs of holes are provided but only one hole 228, 229, 230 of each pair is visible on the drawing.

The said fitting of the blades is done in cooperation with other complementary blades 231, 232, 233 shaped with a curved end (which for the blade 223 is indicated by 233A) to be engaged in a second recess 195F, 196F, 197F opposite the other recess of the 195B type present in each blade.

In this manner the rear of said recess rests on the recess created by the curved ends of type 233A to establish contact between the two parts but with a certain freedom to deform mutually, so as to determine an elastic preloading sufficient to ensure that the two superposed blades 195, 231 (specifically their flat parts 195A, 231B) fit into their seat, which in this specific case is the seat indicated by 222. The current withdrawn from the track piece in the manner illustrated therefore reaches the terminals 231C, 232C, 233C provided with screws 234 or other means for connection to the various user appliances by flexible electric cables. These cables are locked by a cable clamp 238, then passed through an inner hole 239 to finally leave the box through an outer hole 240. The half-casing 208 is hinged to a further half-casing 235 by a long pin 236 which joins together the two complementary hinge parts by passing through holes 237 contained in them. For safety reasons said half-casings must not be able to be opened when the blade portions 195D, 196D, 197D are in contact with the conductors (71, 72, 73 of FIG. 11). This is achieved in the illustrated box device by combining the operating or selection control with locking devices.

These devices are structured as follows.

The connecting bar 212 is guided in its sliding movements by resting against a smooth flat region 208A of the half-casing. The connecting bar comprises a flexible prong 212A having at its end a tooth 212B which when the drilled knob 213 is in a rest position (no electrical contact with the track piece) is located in a slot 244 in the position set by a sliding pin 245, the spheroidal head of which is in contact with the inner flat surface 216A of the protection cover 216, which is fixed by screws. In this manner, any sliding of the connecting bar 212 is prevented as is any operation of the knob 213. This occurs however only when the box is open. In this respect, when the half-casing 235 is closed onto the other half-casing 208, its edge 235A urges the tooth 212B out of its seat to therefore allow free selective sliding of the connecting bar 212. As said rest position corresponds to a position of maximum distance between the connecting rod and the holes 205A, 206A, 207A , any movement of the connecting rod causes it to approach these pivoting holes.

This characteristic is used to cause a second flat prong 212C in a recess 235B in a cheek 235C which projects beyond the surface of the region 208A by passing through a hole 246. In this respect, when in the end positions in which contact is made with the two electrical phases present in the track piece, the prong 212C is positioned within the recess 235B to thus prevent extraction of the cheek 235C, or the separation or opening of the half-casing (on which it is located) from the other half-casing 208, by which the box device is clamped onto the track piece. A small rotary key 247 can be freely engaged against an edge 248 of the half-casing 235 to provide a further locking guarantee for the box device.

I claim:

1. A system for building up electrified lines in the form of exposed modules for supporting user appliances, particularly lighting lamps for interior environments, comprising electrically conducting track pieces of composite structure and standardized length, conductors extending along said track pieces to form electrical lines, said track pieces being connectable together with the aid of interposable means to form various geometrical configurations suggested by aesthetic and/or functional requirements, and being combinable with supports for user appliances, particularly lamps of various types, along their entire length, said interposable means comprising a female node comprising a prismatic box of square cross-section which is open at one of its ends, a plurality of first insulating elements adapted to be inserted into said open end of said prismatic box, profiled conductor layers, second insulating elements acting as spacers, said first insulating elements being provided with seats for receiving said profiled conductor layers and said second insulating elements, said profiled conductor layers being identical and each comprising four individual blades bent in such a manner that when associated with each other in perpendicular directions said blades form a shape similar to a quatrefoil.

2. A system as claimed in claim 1, characterised by having two operating voltages.

3. A system as claimed in claim 1, further comprising end flanges comprising pins of rectangular cross-section, said pins engaging said female node, said pins being inserted into corner recesses defined when two of said individual blades are placed side by side, such that said two individual blades have two free ends which act in a cantilever manner and thus exert a contact pressure against sides of the rectangular cross-section of the pins.

4. A system as claimed in claim 1, wherein said prismatic box of which is characterised by a structure having straight side walls provided with a predetermined perimetral cut along which a certain strip can be broken off to allow the pins projecting from the track piece to gain access to the interior of said corner recesses.

5. A system for building electrified lines, comprising a prismatic female node box having, a base provided with a bored column, an insulating element having a square seat, said column having a top end resting in said square seat and thereby spacing said insulating element from said base a plurality of track pieces and conductors extending along said track pieces for conducting electricity, a plastic box comprised of first and second half-boxes joined together by first screws, one end of at least one of said track pieces being connected to said plastic box, at least one peg fixed to said first and second half-boxes by tightening second screws through holes in said first half-box, third screws inserted through holes provided in a closed end of said base, said third screws mechanically fixing said peg in a transverse direction, a profiled conductor comprising four individual blades bent in such a manner that when associated with each other in perpendicular directions they form a shape similar to a quatrefoil, said profiled conductor being received in said seat of said insulating element, said spacing of said insulating element, said spacing of said insulating element from said base being such as to position said profiled conductor at a distance which cannot be reached by said third screws, said track pieces being electrically connected to said profiled conductor of said prismatic female node box.

6. A system as claimed in claim 5, wherein said prismatic female node box is closed by an end plug shaped with four fins which each rest on a corresponding intermediate portion of the four constituent blades of the quatrefoil, said closed end of said prismatic female node box also comprising a central perimeter for resting against a flat end of said insulating element, to enable corner screws inserted through relative holes to clamp together all the superposed or layered components contained in said prismatic female node box.

7. A system as claimed in claim 5, wherein all parts of said prismatic female node box are connected together axially by a long central screw having one end engaged in a plug provided with undercut grooves for receiving the head of support means.

8. A system as claimed in claim 5, comprising, between the track pieces, copper pins having flat conducting heads shaped with a sledge profile and also having a double bend to form a surface perpendicular to an axis of a blade so that it can rest against a thickened edge of the facing region of a raised portion of a support having a height, above a plane of an insert, which is equal to the thickness of an edge of a removable seat, to rest on said plane with its pins inserted into conjugate holes, said removable seat being provided with a groove in which the blade is housed so as to be guided in its elasticized planar movements under the action of a spring, said spring having one end contained in a cavity formed as an enlargement of said groove and its other end contained in a recess provided in the head of said blade to also provide an axial retention action against the insertion and extraction force of said pins.

9. A system as claimed in claim 8, wherein the retention of the various blades of said pins is assisted by their tooth, which engages against the edges of separation walls between various electrical conductors.

10. A system as claimed in claim 5, wherein at least two of said track pieces are associated with said conductors which are bare and of rectangular cross-section, said conductors being in a position inaccessible to manual contact if provided for the transit of high voltage currents, and in an accessible position if provided for the transit of low voltage currents, occasional currents or earth currents, and with which covered conductors can be associated by being positioned within tubular compartments inaccessible from the outside of said track pieces.

11. A system as claimed in claim 5, wherein said track pieces further comprise intermediate supports having walls which can be broken through to give partial or through access to said track pieces depending on whether they are located at the end or in an intermediate position, said intermediate supports being provided with undercut grooves for their support by suspension-fixing means.

12. A system as claimed in claim 5, further comprising an entry or exit box consisting of a central body associated with a first, a second and a third cover, the first cover facing a first compartment where line voltage is present, whereas the third cover faces a second compartment where a lower voltage is present, to allow access of a first conductor into one or other of said compartments through a single hole provided in a position corresponding with a separation wall having an aperture through which the first conductor gains access to the required compartment by being bent to one side or the other, said aperture being closed on the non-voltage side by a cover fixed by engagement means passing into holes in the separation wall and located in the other of the two compartments.

13. A system as claimed in claim 12, comprising a box characterized by a separation wall having column projections on both its faces, for insertion into holes in main voltage terminal blocks or low voltage terminal blocks, said terminal blocks to be connected to conductor blades by electric cables.

14. A system comprising entry or exit boxes as claimed in claim 12, characterized by a double conformation such that it can be associated with electrically conducting track pieces at either of their ends.

15. A system comprising entry or exit boxes as claimed in claim 12, characterized by a first wall which can mate with an equivalent wall of another box, said first wall being provided with a hole for each of said first and second compartments, said two holes being surrounded on the outside of said first wall one with a projecting circular ring and the other with an equal annular recess, to form male-female elements to be engaged with similar female-male elements on said equivalent wall of the other box with which it is to combine, said holes being defined by through arcuate slots to allow breaking off.

16. A system as claimed in claim 8, wherein said individual blades include heads bent perpendicular to their elastic bending plane to provide preloading for electrical contact.

17. A system as claimed in claim 16, wherein said bent-head blades are fixed to an insert fixed to said prismatic female node box by friction by inserting said bent-head blades edgewise into a seat defined by ledges integral with a plastic structure of said insert and having a certain flexural yieldability which both facilitates the edgewise introduction of bent-head blades and is sufficient to then retain said bent-head blades in situ in the insertion-extraction direction.

18. A system as claimed in claim 17, wherein said blades are characterized by being retained in position against movement in certain directions by their positive engagement with one of said ledges and with a support surface, and being retained against movement in other directions perpendicular to the certain directions by the engagement of a tooth, said tooth being housed in a cavity in said insert.

19. A system as claimed in claim 17, wherein said blades are aided in their fixing in position by the terminal screws used for clamping electric cables.

20. A system as claimed in claim 17 wherein said blades have retention ledges which are added as part of said insert.

21. A system as claimed in claim 5, further comprising fluorescent tube supports comprising a length of one of said electrically conducting track pieces and a left hand casing which comprise forked supports for retaining fluorescent tubes, said casing consisting of a base box provided lowerly with a region closable by a cover provided with internal columns, by means of by self-tapping screws inserted through holes in the center of a recess and in the center of said columns, which are to be inserted into recesses milled out of the edges of a length of said electrically conducting track piece, said region being also provided for housing and retaining an electrical contact insert or unit.

22. A system as claimed in claim 5, characterized by a box provided with upper and lower members for housing transformers for converting the line voltage into lower voltage or for housing other electrical or electronic components required for the lamp operation.

23. A system as claimed in claim 5, characterized by electrical or electronic components mounted inside the boxes after having been previously fixed to rectangular flat bases or plates.

24. A system as claimed in claim 5, characterized by, for containing a feeder, an entry box comprising a suitable box member defined by a dividing wall containing grooves to allow screws to move transversely in order to fix a metal plate-shaped base of said feeder to said dividing wall.

25. A system as claimed in claim 5, comprising a fluorescent tube support characterized by a base box containing to the sides of its end surface holes to enable a second box to be joined to it which has a connector for the track piece when required by the geometrical configuration of the system, said base box being either simple or of the fluorescent tube support type and therefore of a shape and characteristics which are specular to the second box.

26. A system as claimed in claim 25, characterized by the use of a fork removable from the base box by being fixed by screws passing through holes which mate with other analogous holes provided in pegs on the base box, said removability enabling a continuity of elements to be assembled between two opposing forks;

a diffuser plate serving the same purpose to be rotated about the axis of alignment of these elements;

the support element for a fluorescent tube connector to be torsionally fixed by means of a key on a cover fixed to the fork.

27. A system as claimed in claim 26, characterized by a flexible connection between track pieces, which is achieved by a pair of flanges connected together by a flexible band comprising a plurality of electric cables placed side by side in an insulating sheath and connected to said diffuser plate by terminal screws, said flexible band being clamped to a specific flange by a long cableclamping bar.

28. A system as claimed in claim 5, characterized by flanges having one of their sides constructed in one piece, whereas their other side is in two pieces forming two covers, of which one can be fixed by screws passing through said columns, to screw into said recesses in the edges of the track pieces, one cover concerning the mechanical aspect of the flexible connection, whereas the other cover mainly concerns the electrical part of said connection.

29. A system as claimed in claim 5, characterized by a safety box for current withdrawal, consisting of two parts hinged together to clamp an intermediate portion of electrically conducting track piece, and of which a first part comprises an outer member containing female seats for housing a pin to be inserted into analogous female seats in an offset complementary position, and also comprises a plate of complex geometry enclosing an electromechanical switch.

30. A system as claimed in claim 29, comprising an electromechanical switch composed of hoe-shaped blades for insertion through slots in the part to project from it and make contact with the conductors of one said track pieces by a movement in a horizontal transverse direction, the ends of the two said hoe-shaped blades being curved in an opposite direction to that already described, so that they can be swivel-inserted into respective seats of other electrically conducting profiled blades provided with screws and clamping plates for electric cables, said other electrically conducting blades being fixed against the rear side of the complex geometry plate by a screw acting on a plate to interpose phosphor-bronze strips between the flat portions of the hoe-shaped blades and the wall, the purpose of said strips being to prevent the hoe-shaped ends of the hoe-shaped blades from projecting through their slots, the act of projecting for establishing the electrical contact with the conductors being determined by the action of cams.

31. A system as claimed in claim 30, characterized by cams operated by rotating a knob guided by suitable seats provided in said rear side, which is shared to functionally receive the aforesaid parts.

32. A system as claimed in claim 30, characterized in that a part of the safety box is kept locked over the track piece to the rear of the plate by a key, which is rotated to insert its end into a slot.

33. A system as claimed in claim 30, characterized by a box lockable by an internal key which is operated indirectly by said knob on adjusting the angular position of said cams, said knob, when in the position in which the cams are disengaged to enable the blades to elastically retract, allowing a spring to keep a cylindrical head outside a conjugate seat in the part in which it is engaged, the part when in this situation being able to be freely lifted by rotating it about its pin, as inside the conjugate seat there is not only the head but also its shank, thus allowing the part to be lifted while remaining within an open slot having a width greater than the diameter of said shank, whereas when the knob is rotated to engage its cams and cause the hoe-shaped parts of the blades to project and thus make contact with the conductors, it shifts the internal key to overcome the opposing action of the spring and insert the head into its conjugate seat.

34. A system as claimed in claim 5, comprising a box device which can be locked about any region of the track piece, even if already installed, so as to be securely fixed to support a user appliance and also selectively withdraw its required current from one of the two available main electricity lines, characterized by copper or equivalent blades shaped to extend along three geometrical axes to allow them to be inserted into cavities in the track piece of suitable length and to be then moved elastically in a direction perpendicular to said insertion so as to make contact with bare electrical conductors of one of said electrically conducting track pieces, said blades being connected by usual terminal screws to electric wires for electricity feed and withdrawal.

35. A system comprising the box device as claimed in claim 34, characterized by contact blades moved elastically by the action of dissimilar cams which rotate about their axis and joined together by a connecting bar provided with a pin moved by an external rotary knob with its axis coinciding with said cam axes.

36. A system comprising the box device as claimed in claim 34, comprising a connecting bar characterized by a sliding pin having a spheroidal head which makes contact with the inner flat surface of a protection cover;

a prong having at its end a tooth which when a drilled knob is in a position of no elecrrical contact with the track piece is located in a slot in the position set by said sliding pin;

a flat prong in a recess of a cheek which is made to project beyond the surface of an operating region by passing through a hole.

37. A system comprising the box device as claimed in claim 32, characterized by a small rotary key which can be engaged in a freely determinable manner against an edge of the half-casing to provide a further locking guarantee for the box device.

* * * * *